US006715424B2

(12) United States Patent
Yamamoto et al.

(10) Patent No.: US 6,715,424 B2
(45) Date of Patent: Apr. 6, 2004

(54) PRINTING APPARATUS

(75) Inventors: Takaharu Yamamoto, Kyoto (JP); Kazuya Takeda, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/427,993

(22) Filed: May 2, 2003

(65) Prior Publication Data

US 2003/0217660 A1 Nov. 27, 2003

(30) Foreign Application Priority Data

May 22, 2002 (JP) ..... P2002-146997

(51) Int. Cl.[7] ..... B41F 31/02
(52) U.S. Cl. ..... 101/484; 101/365
(58) Field of Search ..... 101/365, 366, 101/483, 484, 211, DIG. 45, 485

(56) References Cited

U.S. PATENT DOCUMENTS

| | | | | | |
|---|---|---|---|---|---|
| 4,329,923 | A | * | 5/1982 | Iida | 101/365 |
| 4,656,941 | A | * | 4/1987 | Brovman | 101/483 |
| 4,881,181 | A | * | 11/1989 | Jeschke et al. | 101/365 |
| 5,010,812 | A | * | 4/1991 | Rodi et al. | 101/365 |
| 5,052,298 | A | * | 10/1991 | Runyan et al. | 101/365 |
| 5,105,739 | A | * | 4/1992 | Osawa et al. | 101/365 |
| 5,138,944 | A | * | 8/1992 | Rancourt et al. | 101/365 |
| 5,170,711 | A | * | 12/1992 | Maier et al. | 101/365 |
| 5,524,542 | A | * | 6/1996 | Toyama | 101/485 |
| 5,907,999 | A | * | 6/1999 | Lusar et al. | 101/484 |
| 5,967,049 | A | * | 10/1999 | Seymour et al. | 101/484 |
| 6,192,147 | B1 | | 2/2001 | Bucher et al. | |
| 6,318,260 | B1 | * | 11/2001 | Chu et al. | 101/365 |
| 6,378,429 | B1 | * | 4/2002 | Tomita et al. | 101/365 |
| 6,412,411 | B1 | * | 7/2002 | Sugiyama et al. | 101/365 |
| 6,412,412 | B1 | * | 7/2002 | Michaud et al. | 101/365 |
| 6,422,142 | B2 | * | 7/2002 | Steinbacher | 101/484 |
| 6,477,954 | B1 | * | 11/2002 | Doherty | 101/365 |
| 6,546,866 | B1 | * | 4/2003 | Adachi | 101/366 |
| 6,622,626 | B2 | * | 9/2003 | Stuhlmiller | 101/484 |
| 6,634,297 | B2 | * | 10/2003 | Poetter et al. | 101/484 |
| 2001/0020427 | A1 | | 9/2001 | Shiraishi | |
| 2002/0043166 | A1 | | 4/2002 | Okuda | |
| 2002/0124752 | A1 | * | 9/2002 | Mayer et al. | 101/365 |

FOREIGN PATENT DOCUMENTS

| | | |
|---|---|---|
| DE | 199 08 295 | 8/2000 |
| JP | 2721171 | 11/1997 |
| JP | 11-268394 | 10/1999 |
| JP | 2000-108308 | 4/2000 |

* cited by examiner

*Primary Examiner*—Eugene H. Eickholt
(74) *Attorney, Agent, or Firm*—McDermott, Will & Emery

(57) ABSTRACT

An ink supply controller capable of generating a proper ink curve from a result of printing even when there is a small difference in image area percentage between ink key regions is provided. The ink supply controller includes an old job data storing element for storing old job data; a new job data acquiring element for acquiring new job data; an ink curve generating element for generating an ink curve based on the old job data and the new job data; an ink curve display element for displaying the generated ink curve; and an updating element for updating the old job data by using the generating ink curve. The ink curve generating element acquires data parameters for generation of the ink curve from both the old job data and the new job data to set an approximate curve obtained from a distribution of these data parameters as a new ink curve.

20 Claims, 10 Drawing Sheets

PRINTING APPARATUS

BACKGROUND OF THE INVENTION

1. Field of the Invention

The present invention relates to an ink supply controller for controlling the amount of ink supply in a printing apparatus including an ink supply means such as an ink fountain device.

2. Description of the Background Art

A typical offset printing apparatus includes an ink supply device or the like having a plurality of ink keys to variably adjust the amount of ink supply to each of a plurality of regions (ink key regions) extending in the feed direction of a printing sheet. This ink supply device controls the amount of ink supply in accordance with an image area percentage on a printing plate. An example of such a technique, as disclosed in Japanese Patent Application Laid-Open No. 11-268394 (1999), is as follows. Data (ink curve data) indicating a relationship between the image area percentage and the amount of ink supply (or an ink key opening) are previously stored in a database or the like. The image area percentage of an image is measured for each of the ink key regions, and the ink key opening is adjusted in accordance with each measurement result so that an optimum printing density is achieved.

However, the relationship between the image area percentage and the ink key opening varies depending on printing conditions susceptible to a printing environment. For this reason, the above-mentioned database or the like must be updated for each print job.

One of the simplest methods of updating the database is considered to include updating the database each time a new print job is executed. However, if the new print job is to print an image such that the values of the image area percentage are distributed locally within some limited range, resultant ink curve data is of low accuracy outside this range.

FIG. 6 shows an example of distribution of the ink key opening versus the image area percentage by using dots D1 to D6 in the form of solid circles when the values of the image area percentage in the respective ink key regions are distributed locally within some limited range in the above-mentioned manner, that is, when there is a small difference in image area percentage between the ink key regions. This example corresponds to an instance in which there is no data in a high image area percentage region since the overall low color density concerned on a print image of a color corresponding to the printing plate results in low image area percentage. In such a case, if the ink curve data is updated using only the data obtained when executing the new print job, there is a likelihood that error or deviation from the proper ink curve data is increased in the high image area percentage region.

SUMMARY OF THE INVENTION

The present invention is intended for a technique for controlling supply of ink in a printing apparatus.

According to the present invention, a printing apparatus having a plurality of ink keys for controlling the supply of ink while adjusting the opening of each of the ink keys in accordance with predetermined ink curve data to thereby perform printing, comprises: a data storing element for storing at least one first ink curve data; a data acquiring element for acquiring a plurality of data values each indicating a corresponding relationship between an image area percentage of a printing plate and a convergent value of the opening of each of the ink keys; and an ink curve generating element for generating second ink curve data based on one first ink curve data selected from the at least one first ink curve data and the plurality of data values.

Preferably, the ink curve generating element acquires a first parameter and a second parameter to generate the second ink curve data from the first and second parameters, the first parameter being at least one data value indicative of the one first ink curve data, the second parameter being at least one of the plurality of data values.

Preferably, the ink curve generating element generates the second ink curve data from an approximate curve obtained from a distribution of the first and second parameters represented in a two-dimensional coordinate system.

For execution of a new print job, the ink curve is generated by using not only the data about the distribution of the convergent key opening versus the image area percentage in each ink key region for a printing plate to be used but also the data about the ink curve used in previous printing. This allows the generation of a proper ink curve even when a printing plate for the new print job has a small difference in image area percentage between the ink key regions.

It is therefore an object of the present invention to provide a printing apparatus capable of generating a proper ink curve from a result of printing even when there is a small difference in image area percentage between ink key regions.

These and other objects, features, aspects and advantages of the present invention will become more apparent from the following detailed description of the present invention when taken in conjunction with the accompanying drawings.

DESCRIPTION OF THE PREFERRED EMBODIMENTS

Description of Printing Apparatus

Figure 1:
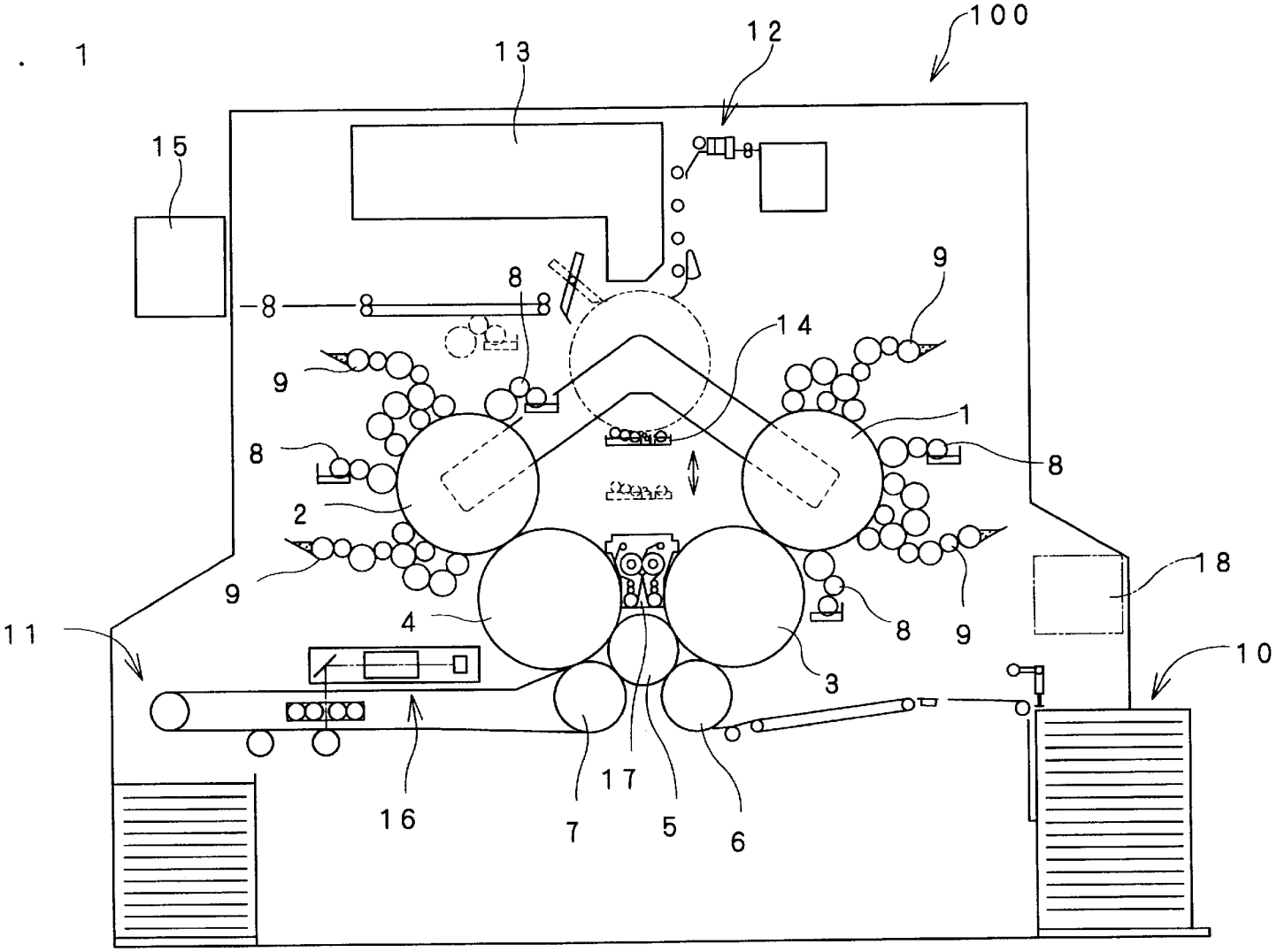
FIG. 1 is a schematic view of an example of a printing apparatus according to a preferred embodiment of the present invention.

A printing apparatus 100 according to a preferred embodiment of the present invention will now be described with reference to the drawings. FIG. 1 is a schematic view of an example of the printing apparatus 100.

Referring first to FIG. 1, the printing apparatus 100 comprises, as a printing mechanism: first and second plate cylinders (or ink transfer mechanisms) 1 and 2 for holding printing plates; first and second blanket cylinders 3 and 4 for transfer of an ink image from the respective plate cylinders 1 and 2 thereto; an impression cylinder 5 for holding a paper sheet (or a printing medium) p to be printed to which the ink image is transferred from the blanket cylinders 3 and 4; a paper feed cylinder 6 and a paper discharge cylinder 7 for feeding and discharging the sheet p to and from the impression cylinder 5; dampening water supply mechanisms 8 and ink supply mechanisms 9 for supplying dampening water and ink, respectively, to the printing plates on the first and second plate cylinders 1 and 2; a paper feed section 10 for sequentially feeding unprinted paper sheets p arranged in a stacked relation; and a paper discharge section 11 for sequentially receiving printed paper sheets p to form a stack.

As a prepress (or plate making) mechanism, the printing apparatus 100 comprises: a printing plate supply section 12 for supplying unexposed printing plates to the first and second plate cylinders 1 and 2; an image recording section 13 for recording an image on the printing plates held on the plate cylinders 1 and 2; a development section 14 for developing the printing plates with the image recorded thereon; and a printing plate discharge section 15 for discharging used printing plates.

The printing apparatus 100 further comprises an image reader 16 for capturing an image on the printed sheet p to measure an image density; a cleaning device 17 for cleaning the blanket cylinders 3 and 4; and a controller 18 for controlling the overall printing apparatus 100.

The parts of the printing apparatus 100 will be described in detail. The first plate cylinder 1 is movable by a plate cylinder drive mechanism not shown between a first printing position shown by a solid line in FIG. 1 and an image recording position shown by a dash-double dot line. Likewise, the second plate cylinder 2 is movable by a plate cylinder drive mechanism not shown between a second printing position shown by a solid line in FIG. 1 and the image recording position shown by the dash-double dot line.

Specifically, the first and second plate cylinders 1 and 2 are in the first and second printing positions, respectively, when a printing process is performed, and are alternately located in the image recording position when a prepress (or plate making) process is performed on the printing plates held on the plate cylinders 1 and 2. Each of the first and second plate cylinders 1 and 2 has a peripheral surface capable of holding thereon two printing plates for two respective colors, and includes a pair of gripping mechanisms for fixing the printing plates, respectively, in circumferentially opposed positions 180 degrees apart from each other on the peripheral surface.

The first blanket cylinder 3 is adapted to rotate in contact with the first plate cylinder 1 in the first printing position. Likewise, the second blanket cylinder 4 is adapted to rotate in contact with the second plate cylinder 2 in the second printing position. The first and second blanket cylinders 3 and 4 are approximately equal in diameter to the first and second plate cylinders 1 and 2, and have a blanket mounted on their peripheral surface for transfer of ink images of two colors from each of the plate cylinders 1 and 2.

The impression cylinder 5 has a diameter approximately one-half the diameter of the first and second plate cylinders 1 and 2, and is adapted to rotate in contact with both of the first and second blanket cylinders 3 and 4. The impression cylinder 5 includes a gripping mechanism capable of holding the single sheet p having a size corresponding to that of the printing plate. The gripping mechanism is opened and closed in predetermined timed relation by an opening/closing mechanism not shown to grip a leading end of the sheet p.

The paper feed cylinder 6 and the paper discharge cylinder 7 are approximately equal in diameter to the impression cylinder 5, and each includes a gripping mechanism (not shown) similar to that of the impression cylinder 5. The gripping mechanism of the paper feed cylinder 6 is positioned to pass the sheet p in synchronism with the gripping mechanism of the impression cylinder 5, and the gripping mechanism of the paper discharge cylinder 7 is positioned to receive the sheet p in synchronism with the gripping mechanism of the impression cylinder 5.

The first and second plate cylinders 1 and 2 in the first and second printing positions, the first and second blanket cylinders 3 and 4, the impression cylinder 5, the paper feed cylinder 6 and the paper discharge cylinder 7 are driven by a printing driving motor not shown to rotate in synchronism with each other. In the printing apparatus 100, since the plate cylinders 1 and 2 and the blanket cylinders 3 and 4 have a circumference approximately twice greater than that of the impression cylinder 5, the impression cylinder 5 rotates two turns each time the plate cylinders 1 and 2 and the blanket cylinders 3 and 4 rotate one turn. Thus, two turns of the impression cylinder 5 with the sheet p held thereon effect multicolor printing using two colors from the first plate cylinder 1 and two colors from the second plate cylinder 2 or a total of four colors.

Two dampening water supply mechanisms 8 are provided for each of the plate cylinders 1 and 2 in the first and second printing positions, and are capable of selectively supplying the dampening water to the two printing plates on each of the plate cylinders 1 and 2. Each of the dampening water supply mechanisms 8 includes a water fountain for storing the dampening water, and a set of dampening water rollers for drawing up the dampening water from the water fountain to pass the dampening water to a printing plate surface. At least some of the set of dampening water rollers which contact the printing plate surface are brought into and out of contact with a plate cylinder surface by a cam mechanism. The dampening water supply mechanisms 8 need not be provided if the printing plates are of the type which requires no dampening water.

Two ink supply mechanisms 9 are provided for each of the plate cylinders 1 and 2 in the first and second printing positions, and are capable of selectively supplying inks of different colors to the two printing plates on each of the plate cylinders 1 and 2. Each of the ink supply mechanisms 9 includes an ink duct or ink fountain capable of adjusting the amount of ink supply for each of a plurality of regions arranged in a direction perpendicular to the print direction, and a plurality of ink rollers for transferring the ink from the ink duct onto the printing plate surface. At least some of the ink rollers which contact the printing plate surface are constructed to be brought into and out of contact with the plate cylinder surface by a cam mechanism.

Since the ink duct is know in the art, only the basic structure of the ink duct will be described. FIG. 2A is a schematic sectional view of the ink duct as seen in the axial direction of the rollers, and FIG. 2B is a schematic sectional view of the ink duct as seen in a direction perpendicular to the axial direction of the rollers.

Figure 2B:
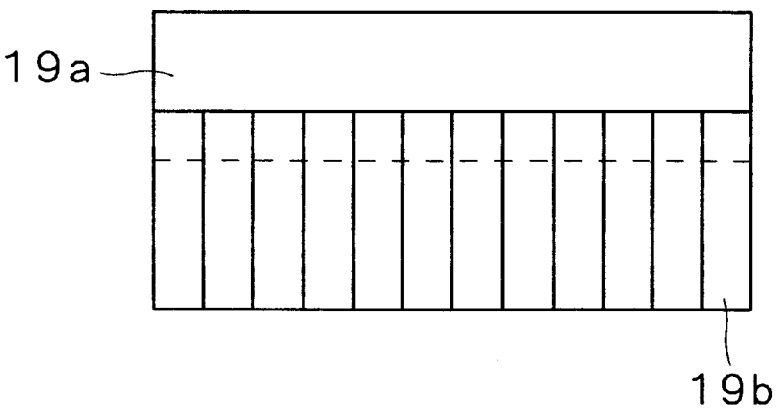
FIGS. 2A and 2B are schematic views of an example of an ink supply device.
Figure 2A:
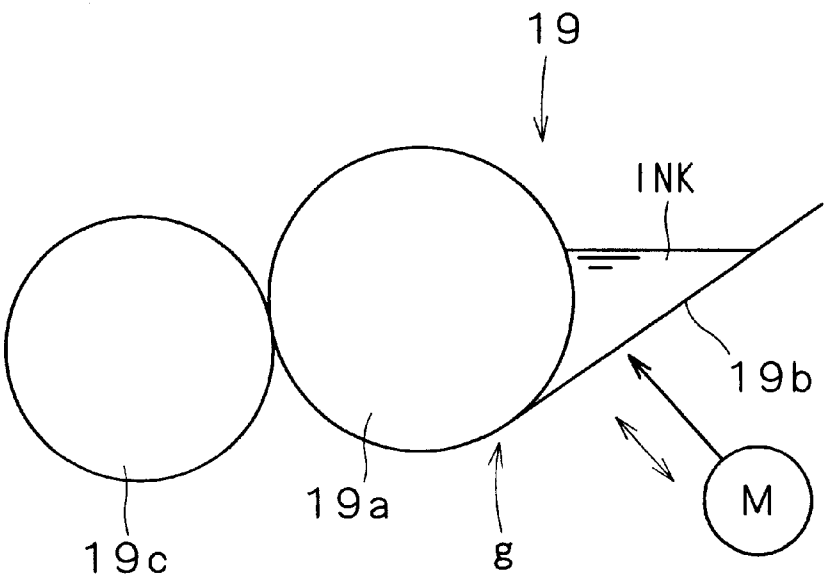

An ink duct 19 shown in FIGS. 2A and 2B includes an ink fountain roller 19*a*, and a plurality of ink keys 19*b* in sheet form arranged in the axial direction of the rollers so as to contact the ink fountain roller 19*a*. A well defined by the ink fountain roller 19*a* and the ink keys 19*b* is filled with ink. As the ink fountain roller 19*a* rotates, an ink layer having a thickness corresponding to the size of a gap g between the ink fountain roller 19*a* and the ink keys 19*b* is formed on the surface of the ink fountain roller 19*a*. The ink layer on the ink fountain roller 19*a* is transferred through the plurality of successive ink rollers including an ink ductor roller or vibrating roller 19*c* for contact with the ink fountain roller 19*a* (although other ink rollers than the ink ductor roller 19*c* are not shown in FIG. 2A) to the printing plate surface.

The ink duct 19 is provided with an individual motor M for each of the ink keys 19*b*. Each ink key 19*b* is moved toward and away from the ink fountain roller 19*a* by the individual motor M, thereby to adjust the size of the gap g. This allows the adjustment of the amount of ink supplied on the basis of the size of the ink keys 19*b* as a unit.

The inks in the ink supply mechanisms 9 are, for example, such that the ink supply mechanisms 9 for K (black) and M (magenta) colors are provided for the first plate cylinder 1, and the ink supply mechanisms 9 for C (cyan) and Y (yellow) colors are provided for the second plate cylinder 2. At least some of the dampening water supply mechanisms 8 and ink supply mechanisms 9 which lie on the paths of movement of the first and second plate cylinders 1 and 2 are adapted to be shunted out of the paths of movement as the first and second plate cylinders 1 and 2 move.

The paper feed section 10 feeds paper sheets p, one at a time, from a stack of unprinted paper sheets p to the paper feed cylinder 6. In this preferred embodiment, the paper feed section 10 operates so that one paper sheet p is fed each time the paper feed cylinder 6 rotates two turns. The paper discharge section 11 receives printed paper sheets p from the paper discharge cylinder 7 to form a stack. The paper discharge section 11 includes a known chain transport mechanism for discharging and carrying a printed paper sheet p, with the leading end of the printed paper sheet p gripped by a gripper (or gripper finger) carried around by a chain. The image reader 16 is provided at some midpoint in the path of movement of the printed sheets p discharged by the paper discharge section 11.

Next, the prepress mechanism of the printing apparatus 100 will be described. In the printing apparatus 100, the first and second plate cylinders 1 and 2 are alternately moved to the image recording position during the execution of the prepress process. In this image recording position, a friction roller not shown is driven to rotate in contact with the plate cylinder 1 or 2.

The printing plate supply section 12 includes a cassette roll for storing a roll of unexposed printing plate while shielding the roll of unexposed printing plate from light, a transport roller and a transport guide for transporting the printing plate unwound from the cassette roll to the plate cylinder 1 or 2, and a cutting mechanism for cutting the printing plate into sheet form. In this preferred embodiment, a silver halide sensitive material is used for the printing plate, and laser light is used to record an image on the printing plate. The procedure of a printing plate supply operation includes: causing one of the gripping mechanisms not shown of the plate cylinder 1 or 2 to grip the leading end of the printing plate unwound from the cassette roll; rotating the plate cylinder 1 or 2 in this condition to wind the printing plate around the plate cylinder 1 or 2; then cutting the printing plate to length; and causing the other gripping mechanism to grip the trailing end of the printing plate.

The image recording section 13 turns on/off laser light to expose a printing plate to the light, thereby recording an image on the printing plate. In this preferred embodiment, the controller 18 determines the position of the image on the printing plate, and sends corresponding image data to the image recording section 13. The image recording section 13 effects main scanning with the laser light emitted from a laser source in the axial direction of the plate cylinder 1 or 2 by using a polarizer such as a polygon mirror, while effecting sub-scanning over the printing plate surface by rotating the plate cylinder 1 or 2.

The method of scanning may be of the type such that a plurality of laser sources are arranged in the axial direction of a plate cylinder and main scanning is carried out with a plurality of laser beams emitted from the respective laser sources as the plate cylinder rotates. The printing plate and the image recording section 13 are not limited to those of the type such that an image is recorded by exposure to light, but may be of the type such that an image is thermally or otherwise recorded.

The development section 14 develops the printing plate exposed by the image recording section 13. In this preferred embodiment, the development section 14 draws up a processing solution stored in a processing bath by using a coating roller to apply the processing solution to the printing plate, thereby developing the printing plate. The development section 14 includes an elevating mechanism for moving between a position in which the development section 14 is shunted from the plate cylinder 1 or 2 and a position in which the development section 14 is closer to the plate cylinder 1 or 2. The development section 14 itself need not be provided if an image recording method which requires no development is employed.

In the printing apparatus 100, the first and second plate cylinders 1 and 2 are moved to the image recording position, in which the prepress process is performed by supplying the printing plate and then recording and developing an image. After the prepress process is completed, the first and second plate cylinders 1 and 2 are moved to the first and second printing positions, respectively, for the printing process.

The printing apparatus 100 is capable of automatically discharging the printing plate after the printing process is completed. In this preferred embodiment, the printing plate discharge section 15 includes a peeling section for peeling the printing plate from the first or second plate cylinder 1 or 2 in the image recording position, a transport mechanism for transporting the peeled printing plate, and a discharge cassette for discharging the used printing plate so transported.

Figure 3:
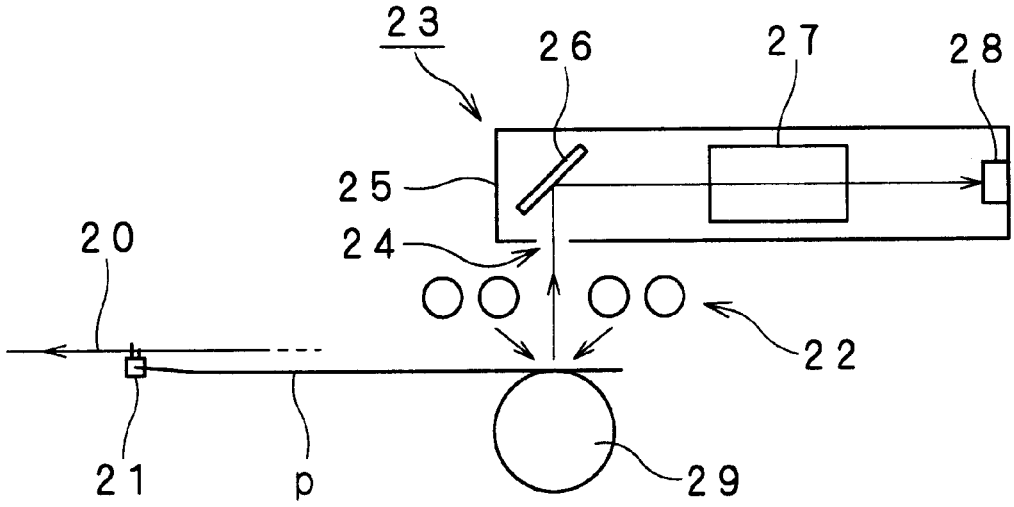
FIG. 3 is a schematic view of an image reader provided in the printing apparatus.

The details of the image reader 16 will be described with reference to the schematic view of FIG. 3. The image reader 16 reads an image on the printed paper sheet p gripped and transported by a gripper (or gripper finger) 21 carried around by a chain 20 of the paper discharge section 11. The image reader 16 includes an illuminating light source 22 for illuminating the printed paper sheet p, and a reader body 23 for receiving light reflected from the printed paper sheet p to convert the reflected light into an image signal.

The illuminating light source 22 includes a plurality of line light sources, e.g. fluorescent lamps, arranged in the feed direction of the printed paper sheet p. The reader body 23 includes a cover 25 formed with a permeable portion 24 for allowing the reflected light to pass therethrough, a reflecting mirror 26 provided in the cover 25, an optical system 27, and a photodetector 28.

The cover 25 blocks out disturbance light, dirt, ink mist and the like. The permeable portion 24 may be closed by using a light-permeable member or the like, or may be open. If the permeable portion 24 is open, it is preferable that a clean air from outside the printing apparatus 100 is introduced into the interior of the cover 25 to prevent dirt from entering the interior of the cover 25 through the permeable portion 24. The reflecting mirror 26 directs incident light from the printed paper sheet p toward the photodetector 28. The optical system 27 includes an optical member such as a lens for image-forming the incident light on the photodetector 28. The photodetector 28 includes a CCD line sensor for reading the printed image, line by line extending in a direction crosswise to the feed direction of the sheet p. This preferred embodiment employs a three-line CCD capable of reading three wavelengths for R, G and B.

The printed paper sheet p transported by the gripper 21 is vacuum-held and transported by a vacuum suction roller 29. This suppresses fluttering of the sheet p during image reading to stabilize the sheet p.

Figure 10:
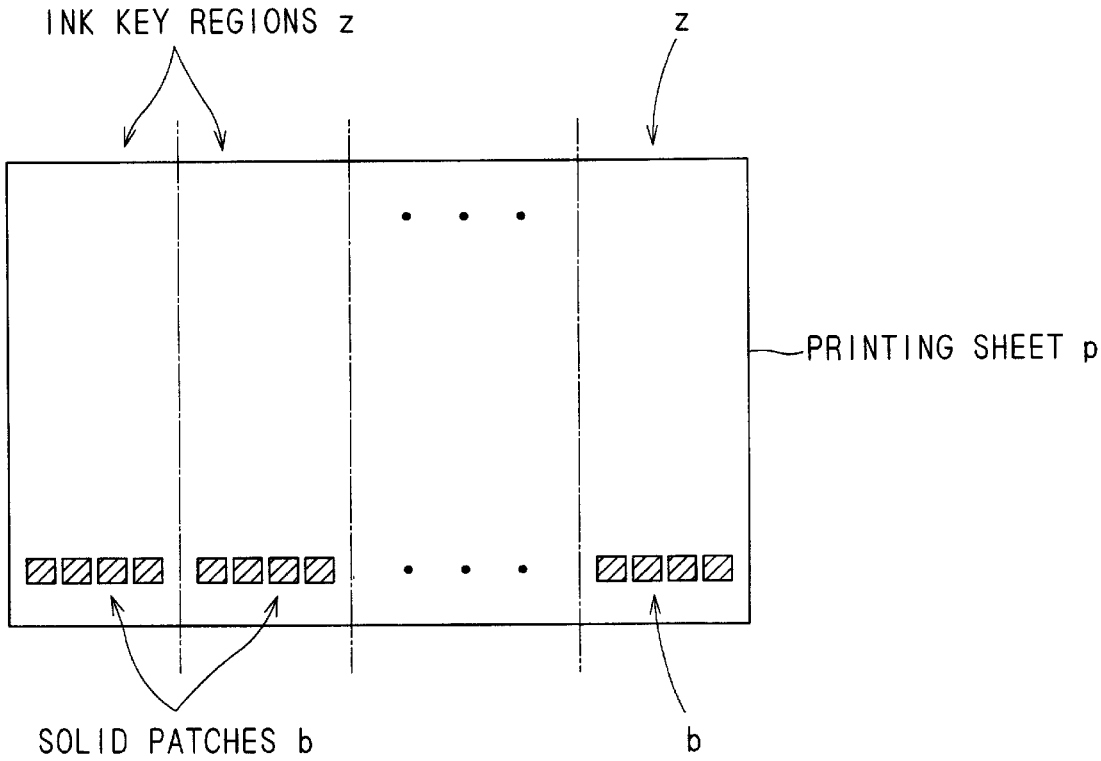
FIG. 10 is a view showing an example of a color chart.

It is desirable that the printed paper sheet p has a predetermined color chart previously formed thereon by the image recording section 13 for each of the regions (ink key regions z) corresponding to respective ink keys. As a typical example shown in FIG. 10, 100% dense solid patches b for respective CMYK colors are formed in an image end portion (typically, on the trailing end of the printed paper sheet p) in each of the ink key regions z. The image reader 16 is capable of imaging the solid patches b to measure the printed densities in the respective ink key regions z. The printed density as used herein refers to an optical reflectance density, for each of the RGB colors, which is measured by the use of a predetermined filter. For each of the YMCK colors, a target printed density to provide a standard printed color on a printed sheet is specified based on the reflectance density of the 100% dense solid patch of each ink. (The standard value thereof in Japan is specified as Japan color.) Other examples of the color charts includes other-than-100% dense halftone dot patches, line patches, and mixed color patches such as gray patches, which may be prepared and used to measure the printed densities and calorimetric densities. If the color charts and the like are not provided, the image reader 16, of course, may capture the printed image itself and measure the printed density and printed color of a predetermined region.

The cleaning device 17 comes in contact with the blanket cylinders 3 and 4 to clean the cylinder surfaces. In this preferred embodiment, individual cleaning devices are provided respectively for the blanket cylinders 3 and 4. The cleaning device 17 includes a cleaning solution supply mechanism, and a wiping mechanism using a cleaning cloth (or wiper).

The controller 18 is a microcomputer system including various input/output sections and storage sections, and is contained in the printing apparatus 100. The controller 18 controls the overall printing apparatus 100 based on a predetermined program operation, and also functions as an ink supply controller for controlling the supply of ink in the ink supply mechanisms 9 in this preferred embodiment. Of course, the ink supply controller according to the present invention may be functioned using a computer system other than the controller 18.

For printing, the controller 18 first sets an initial ink key opening of each ink key in association with the image area percentage in each ink key region of the printing plate, based on predetermined ink curve data. When printing is performed based on this initial setting, the image reader 16 measures the printed density of the color chart on the printed sheet in each ink key region. The controller 18 adjusts the ink key opening so that the printed density of the color chart equals a predetermined reference density. After the adjustment, printing and printed density measurement are performed again. Successive repetition of such an operation causes the printed density to finally reach the reference density, to stabilize the ink key opening. The ink key opening at this time is referred to hereinafter as a convergent key opening. In the controller 18, ink curve data generated in a procedure to be described later for use in printing is previously stored as old job data JD0. Data indicating the distribution of the convergent key opening versus the image area percentage for each ink key which is obtained by adjusting the ink key opening when the latest print job is executed is stored as new job data JD1.

Figure 4:
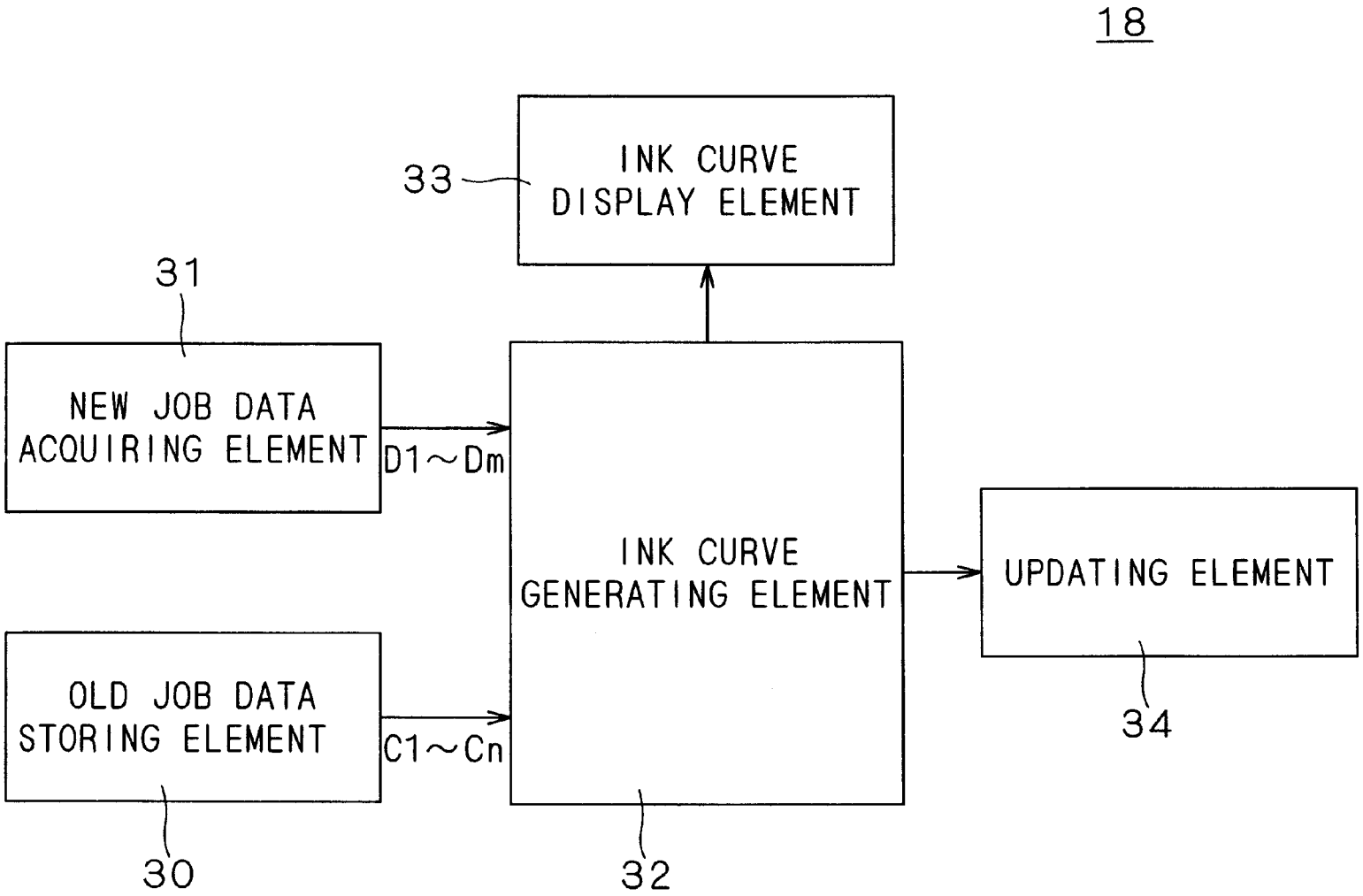
FIG. 4 is a functional block diagram of an ink supply controller.
Figure 5:
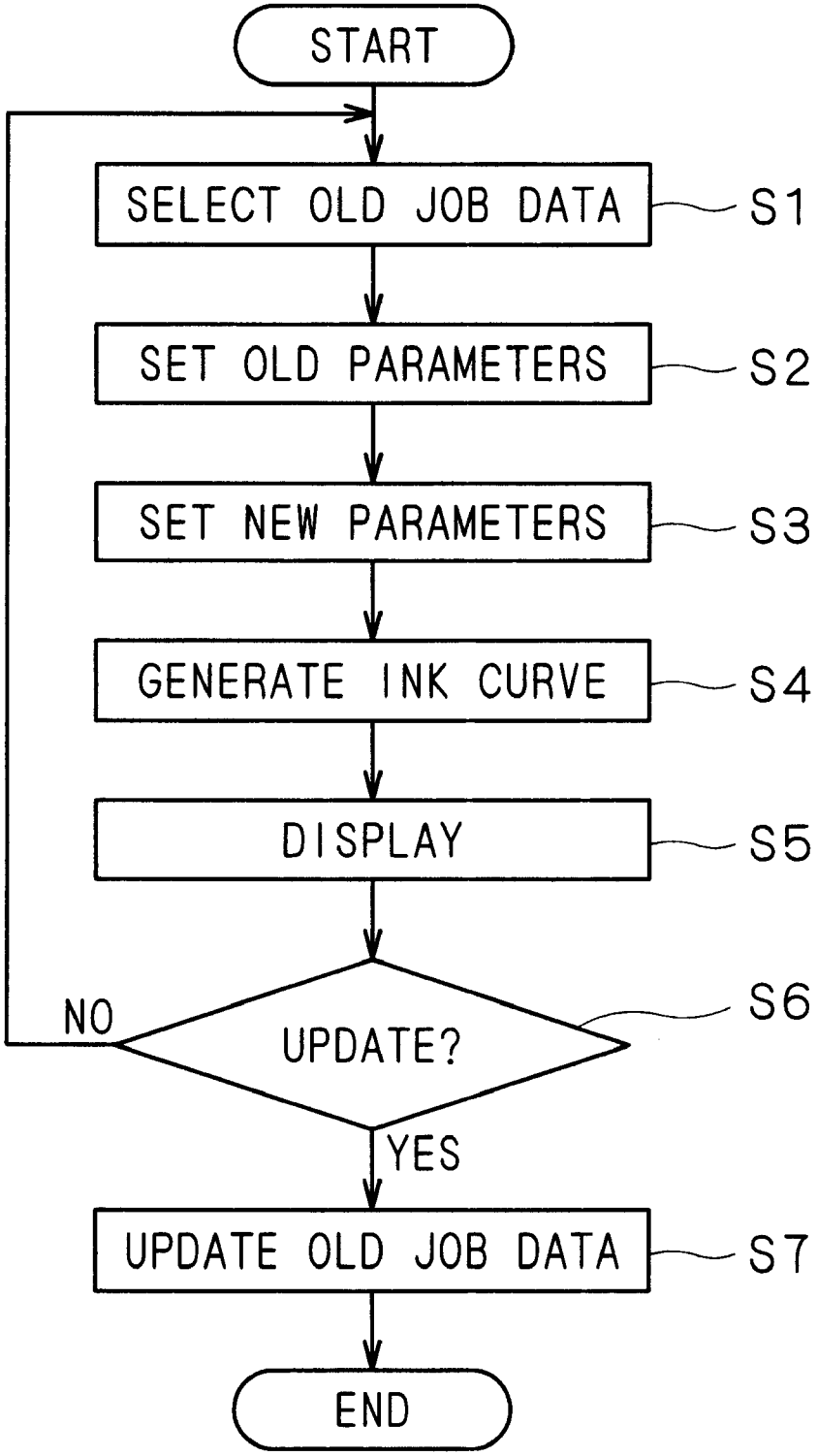
FIG. 5 is a flowchart showing a method of generating and updating an ink curve in the ink supply controller according to the present invention.

Next, description will be given on functions implemented in the controller 18 when the controller 18 acts as the ink supply controller according to the present invention. FIG. 4 is a functional block diagram of the controller 18 when the controller 18 acts as the ink supply controller. FIG. 5 is a flowchart showing the procedure for setting the ink curve data in the ink supply controller.

Referring to FIG. 4, the controller 18 serving as the ink supply controller according to the present invention comprises: an old job data storing element 30 for storing a plurality of old job data JD0; a new job data acquiring element 31 for acquiring the new job data JD1; an ink curve generating element 32 for generating an ink curve based on the old job data JD0 and the new job data JD1; an ink curve display element 33 for displaying the generated ink curve; and an updating element 34 for updating the ink curve data using the generated ink curve.

With reference to the flowchart shown in FIG. 5, an operator initially selects one old job data JD0 for use in update of the ink curve data among the plurality of old job data JD0 stored in the old job data storing element 30 under the action of the ink curve generating element 32 in Step S1.

Figure 6:
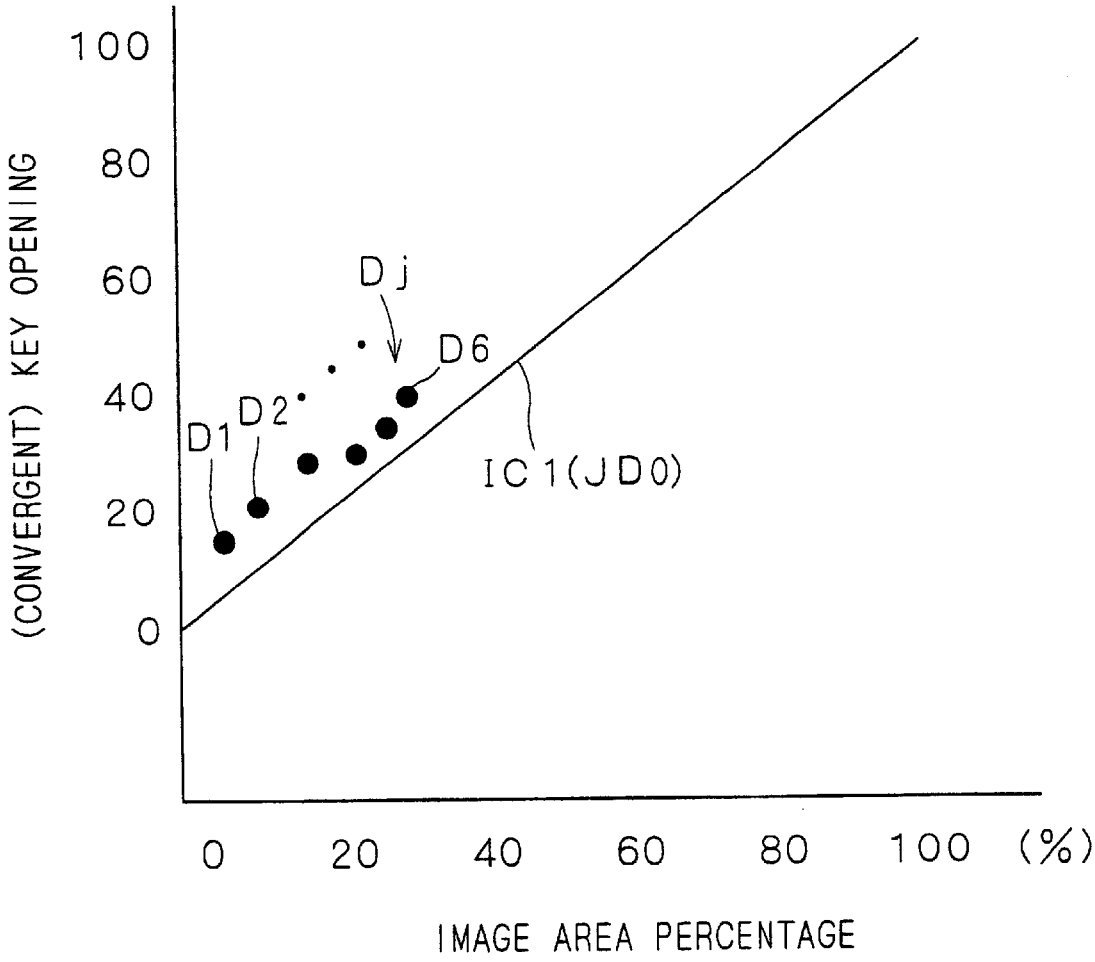
FIG. 6 shows a specific example when new job data are present in a particular limited region.

The old job data storing element 30 is a data storing element in which ink curve data representing an ink curve IC1, for example as shown in FIG. 6, having been used in a past print job is previously stored as the old job data JD0, and is constructed by a memory device such as a computer memory and a hard disk. The ink curve IC1 of FIG. 6 is prepared by plotting the image area percentage in an ink key region along the horizontal axis against the convergent key opening which is an ink key opening obtained when the printed density in the ink key region reaches the predetermined reference density along the vertical axis.

Figure 7:
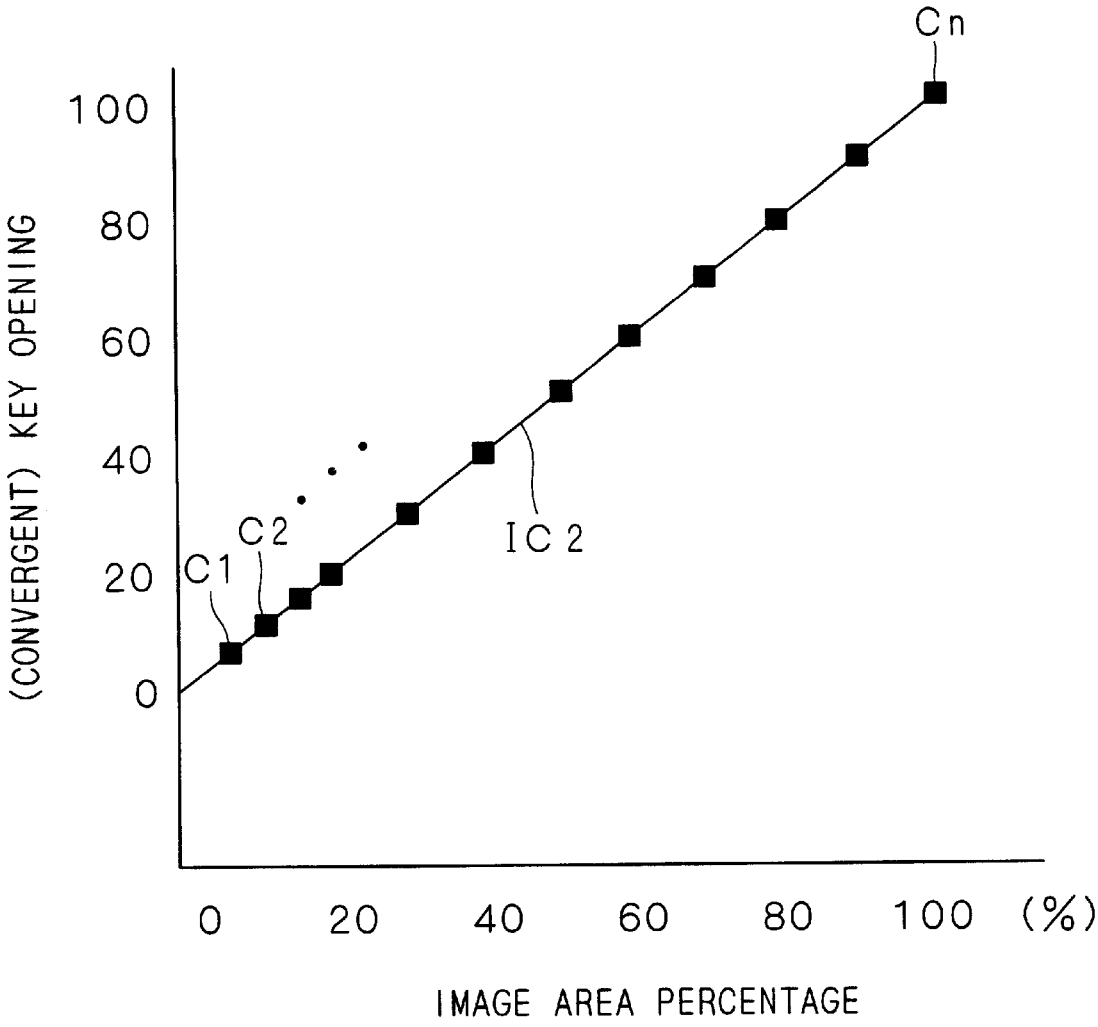
FIG. 7 shows a specific example for extraction of old data parameters from the ink curve.

In Step S2, old data parameters Ci (where i=1 to n, and n is a positive integer) associated with the old job data JD0 from the old job data storing element 30 are set under the action of the ink curve generating element 32. For an ink curve IC2 shown in FIG. 7 as an example, data points corresponding to a plurality of values of the image area percentage are set as the old data parameter C1, C2, . . . Cn, based on the old job data JD0 selected in Step S1 and representing the ink curve IC2. In the instance shown in FIG. 7, n=12, that is, twelve old data parameters C1 to C12 in all are set in 5% increments of the image area percentage in the range from 5 to 20%, and in 10% increments of the image area percentage in the range from 20 to 100%. In this case, the twelve old data parameters C1 to C12 are set all over in the full range of the image area percentage.

In Step S3, new data parameters Dj (where j=1 to m, and m is a positive integer) are set under the action of the new job data acquiring element 31 and the ink curve generating element 32. First, the new job data acquiring element 31 acts to adjust the ink key opening corresponding to the latest print job to provide the new job data JD1 which is distribution data about the convergent key opening versus the image area percentage in each ink key region. At least some of the components of the new job data JD1 are set as the new data parameters D1, D2, . . . Dm by the ink curve generating element 32. In FIG. 6, the new data parameters D1 to D6 when m=6 are illustrated by solid circles.

Figure 8:
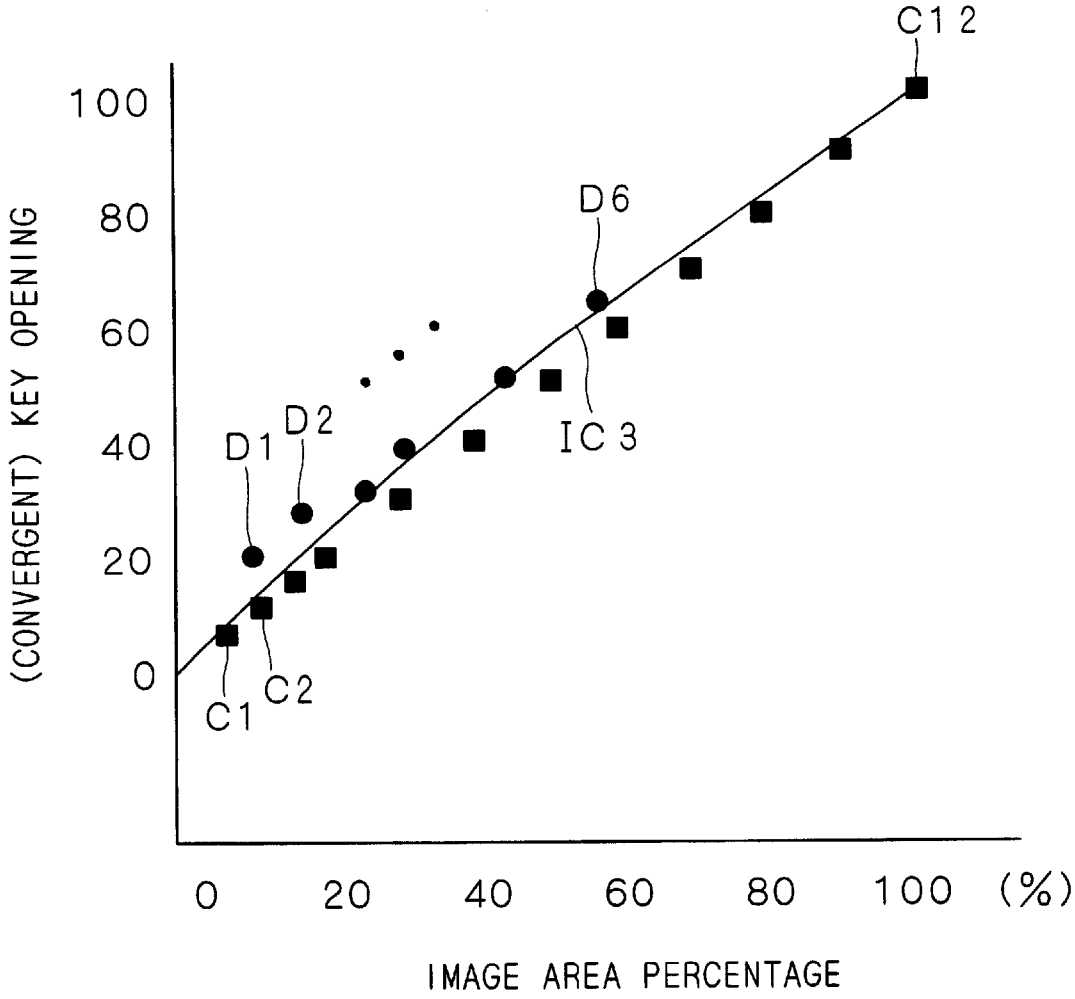
FIG. 8 shows a specific example for generation of an ink curve from new and old data parameters.

In Step S4, the ink curve generating element 32 generates a new ink curve IC3 by approximate computation based on the old data parameters Ci and the new data parameters Dj. As shown in FIG. 8, for generation of the ink curve IC3 based on the twelve old data parameters C1 to C12 and the six new data parameters D1 to D6, an approximate curve (including a straight line) which approximately passes through a total of eighteen data points is determined by approximate computation, e.g. the least squares method. This approximate curve is used as the new ink curve IC3.

In Step S5, the ink curve display element 33 displays the ink curve IC3 computed by the ink curve generating element 32, for example, in graphical form shown in FIG. 8. The ink curve display element 33 is implemented by, for example, a computer display. The old data parameters Ci and the new data parameters Dj may be displayed at the same time the ink curve IC3 is displayed.

In Step S6, the operator judges whether or not to update the ink curve data for use in the print job to new ink curve data based on the ink curve IC3 presented by the ink curve display element 33. If the operator performs the update (or the answer to Step S6 is YES), the processing proceeds to Step S7; otherwise (or the answer to Step S6 is NO), the processing returns to Step S1 to start the operation again.

If there is an inappropriate parameter among the new and old data parameters displayed in Step S5 when the processing returns to Step S1 for correction of the ink curve IC3, the new ink curve IC3 may be generated again by removing the inappropriate parameter. Alternatively, the new ink curve IC3 may be generated again by changing the reflection proportion of the old and new data parameters, which will be described later.

If the operator recognizes the ink curve IC3 and judges to update the ink curve data in Step S6, the updating element 34 acts to update the ink curve data for use in the print job by using data representing the corresponding relationship between the image area percentage and the ink key opening for the ink curve IC3 in Step S7, and the updated ink curve data is used for execution of the print job. In other words, the ink curve data is stored as "new" old job data JD0 in the old job data storing element 30. In this process, the ink curve data may be stored in association with printing conditions or in association with update history.

In this preferred embodiment, the ink curve is generated by using not only the new job data JD1 about the distribution of the convergent key opening versus the image area percentage in each ink key region for a printing plate for use in the execution of the new print job but also the old job data JD0 corresponding to the ink curve used in previous printing. This allows the generation of a proper ink curve even if the printing plate for the new print job is for use in printing an image having a limited range of color density.

Setting of Reflection Proportion

In the above-mentioned preferred embodiment, the old data parameters Ci and the new data parameters Dj are treated equally for generation of the new ink curve. However, the tendency of the distribution of either the old data parameters Ci or the new data parameters Dj may be reflected more significantly in the approximate computation. For example, one of the simplest methods is to variably set the proportions of the number m of new data parameter Dj and the number n of old data parameters Ci. Of course, the higher the proportion (referred to as a reflection proportion) of the number of parameters to be used is, the more significantly the tendency of distribution of the aforesaid parameters is reflected in the new ink curve.

An example of the method of setting the reflection proportion as mentioned above will be described. First, the number m of new data parameters Dj and the number n of old data parameters Ci are determined to satisfy $$m:n=\alpha:(1-\alpha) \tag{1}$$

where $\alpha$ ($0<\alpha<1$) is the reflection proportion of the new data parameters Dj, and $(1-\alpha)$ is the reflection proportion of the old data parameters Ci. For example, when the number n of old data parameters Ci is twelve as discussed above, the number m of new data parameters Dj is determined in association with the number n from Equation (1). Preferably, the new data parameters Dj are acquired which correspond to such values of the image area percentage as to divide the range of the image area percentage in each ink key region in the print job into m parts. Alternatively, the operator may be allowed to select data for use as the new data parameters Dj from the new job data JD1.

After the old and new data parameters Ci and Dj for use in generation of the ink curve are determined based on the reflection proportions as mentioned above, the approximate computation by mean of the least squares method based on the data parameters Ci and Dj produces the ink curve as the approximate curve. For example, a new approximate curve is determined so as to minimize a squared error SE expressed by $$\text{i SE}=\alpha\cdot\text{SEd/m}+(1-\alpha)\cdot SEc/n \tag{2}$$

where SEd is the sum of squared errors between the approximate curve and the new data parameters Dj, and SEc is the sum of squared errors between the new ink curve and the old data parameters Ci. The determined new approximate curve is used as the new ink curve.

Figure 9:
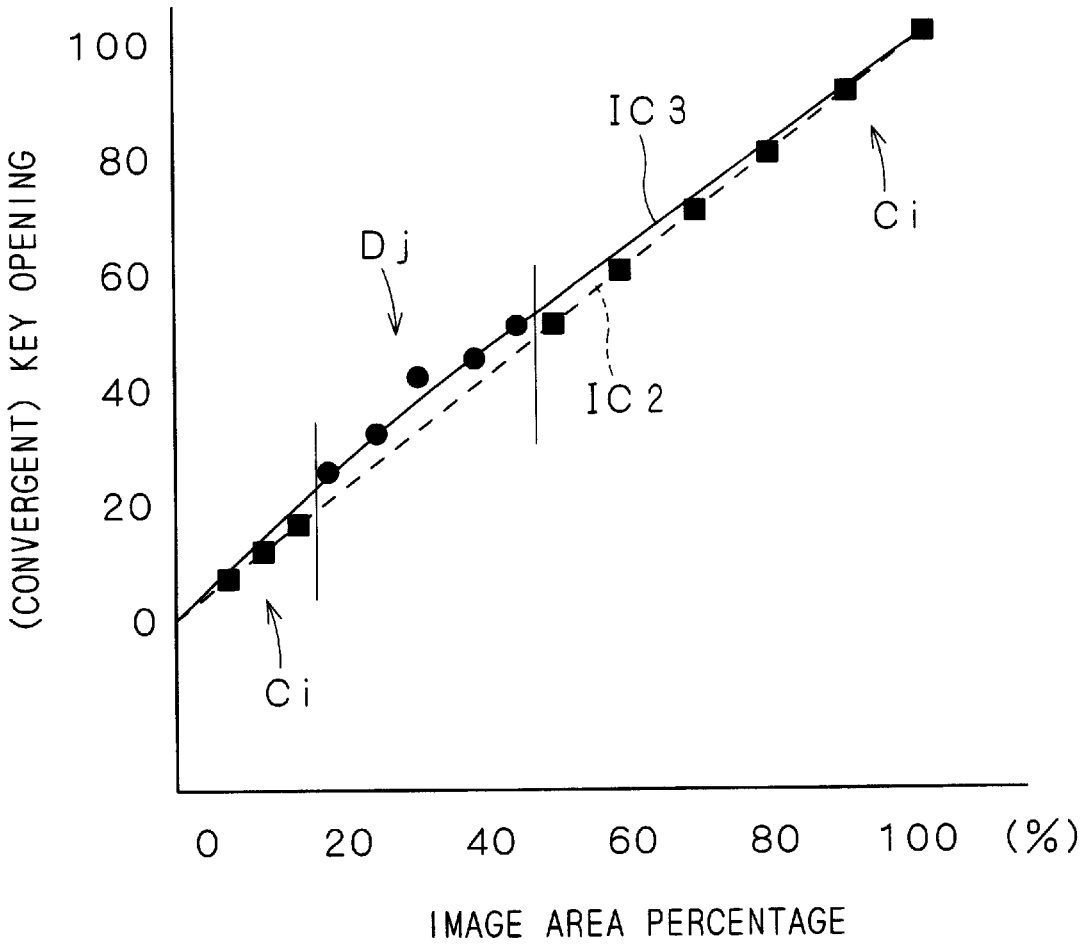
FIG. 9 shows a specific example for extraction of old data parameters from a region in which new job data are absent.

Although the old data parameters Ci are set all over in the approximately full range of the image area percentage in the above-mentioned preferred embodiment, the old data parameters Ci may be selectively set in a range of the image area percentage wherein there are a small number of new data parameters Dj. FIG. 9 shows an example in which the old data parameters Ci are set in a range of the image area percentage wherein it is impossible to sufficiently set the new data parameters Dj because the components of the new job data JD1 are small in number (or cannot be set) in such a manner as to complement the new data parameters Dj. In such a case, of course, a small number of old data parameters Ci may be set in a range of the image area percentage wherein the new data parameters Dj are set.

Modifications (1) The ink curve may be generated for each ink key. This produces ink curves inherent in the respective ink keys, to accomplish higher accuracy control.

(2) The amount of deformation (or the amount of deflection) inherent in the rollers or the amount of correction of the origin of the ink keys may be incorporated into the computation of the ink curve for each ink key. The new data parameters Dj and the old data parameters Ci may be used to compute the amount of deflection or the amount of correction of the origin of the ink keys. In this case, the reflection proportions of the new and old data parameters Dj and Ci may be determined. According to the present invention, the term "ink curve data" will be used herein as inclusive of not only the data about the ink curve itself but also data about the amount of correction of the origin of the ink curve and the amount of deformation correction as described above.

(3) For the ink curve, the number of drive pulses of the motor M for driving each ink key may be used in place of the value of the ink key opening. In this case, the ink curve is prepared as a curve indicative of the relationship between the image area percentage and the number of drive pulses applied when the convergent key opening is reached. The origin of a coordinate system representing the ink curve is determined by the number of pulses serving as the reference of counting of the number of drive pulses.

While the invention has been described in detail, the foregoing description is in all aspects illustrative and not restrictive. It is understood that numerous other modifications and variations can be devised without departing from the scope of the invention.

What is claimed is:

1. A printing apparatus having a plurality of ink keys for controlling the supply of ink while adjusting the opening of each of said ink keys in accordance with predetermined ink curve data to thereby perform printing, said printing apparatus comprising:

a data storing element for storing at least one first ink curve data;

a data acquiring element for acquiring a plurality of data values each indicating a corresponding relationship between an image area percentage of a printing plate and a convergent value of the opening of each of said ink keys; and an ink curve generating element for generating second ink curve data based on one first ink curve data selected from said at least one first ink curve data and said plurality of data values.

2. The printing apparatus according to claim 1, wherein said ink curve generating element acquires a first parameter and a second parameter to generate said second ink curve data from said first and second parameters, said first parameter being at least one data value indicative of said one first ink curve data, said second parameter being at least one of said plurality of data values.

3. The printing apparatus according to claim 2, wherein said ink curve generating element generates said second ink curve data from an approximate curve obtained from a distribution of said first and second parameters represented in a two-dimensional coordinate system.

4. The printing apparatus according to claim 3, wherein said ink curve generating element is capable of variably setting proportions of said first and second parameters for use in generation of said second ink curve data.

5. The printing apparatus according to claim 4, wherein at least one of said first and second parameters for use in generation of said second ink curve data is selectively acquired from a specific data range.

6. The printing apparatus according to claim 5, further comprising an ink curve updating element for additionally storing said second ink curve data as new first ink curve data in said data storing element to allow the use of said second ink curve data for printing.

7. The printing apparatus according to claim 6, wherein said second ink curve data is generated in corresponding relation to each of said plurality of ink keys.

8. The printing apparatus according to claim 7, further comprising a display element for displaying information about the generation of said second ink curve data.

9. An ink supply controller for a printing apparatus, said printing apparatus having a plurality of ink keys for controlling the supply of ink while adjusting the opening of each of said ink keys in accordance with predetermined ink curve data to thereby perform printing, said ink supply controller comprising:

a data storing element for storing at least one first ink curve data;

a data acquiring element for acquiring a plurality of data values each indicating a corresponding relationship between an image area percentage of a printing plate and a convergent value of the opening of each of said ink keys; and an ink curve generating element for generating second ink curve data based on one first ink curve data selected from said at least one first ink curve data and said plurality of data values.

10. The ink supply controller according to claim 9, wherein said ink curve generating element acquires a first parameter and a second parameter to generate said second ink curve data from said first and second parameters, said first parameter being at least one data value indicative of said one first ink curve data, said second parameter being at least one of said plurality of data values.

11. The ink supply controller according to claim 10, wherein said ink curve generating element generates said second ink curve data from an approximate curve obtained from a distribution of said first and second parameters represented in a two-dimensional coordinate system.

12. The ink supply controller according to claim 11, wherein said ink curve generating element is capable of variably setting proportions of said first and second parameters for use in generation of said second ink curve data.

13. The ink supply controller according to claim 12, wherein at least one of said first and second parameters for use in generation of said second ink curve data is selectively acquired from a specific data range.

14. The ink supply controller according to claim 13, further comprising an ink curve updating element for additionally storing said second ink curve data as new first ink curve data in said data storing element to allow the use of said second ink curve data for printing.

15. The ink supply controller according to claim 14, wherein said second ink curve data is generated in corresponding relation to each of said plurality of ink keys.

16. The ink supply controller according to claim 15, further comprising a display element for displaying information about the generation of said second ink curve data.

17. A method of controlling supply of ink in a printing apparatus, said printing apparatus having a plurality of ink keys for controlling the supply of ink while adjusting the opening of each of said ink keys in accordance with predetermined ink curve data to thereby perform printing, said method comprising the steps of:

(a) storing at least one first ink curve data in a data storing element;

(b) acquiring a plurality of data values each indicating a corresponding relationship between an image area percentage of a printing plate and a convergent value of the opening of each of said ink keys;

(c) selecting one first ink curve data from said at least one first ink curve data;

(d) acquiring at least one data value indicative of said one first ink curve data as a first parameter;

(e) acquiring at least one of said plurality of data values as a second parameter;

(f) generating second ink curve data from said first parameter and said second parameter; and (g) additionally storing said second ink curve data as new first ink curve data in said data storing element to allow the use of said second ink curve data for printing.

18. The method according to claim 17, wherein said second ink curve data is generated from an approximate curve obtained from a distribution of said first and second parameters represented in a two-dimensional coordinate system in said step (f).

19. The method according to claim 18, wherein proportions of said first and second parameters for use in generation of said second ink curve data are variably set in said step (f).

20. The method according to claim 19, wherein at least one of said first and second parameters for use in generation of said second ink curve data is selectively acquired from a specific data range in said step (f).

* * * * *